US009900706B2

(12) United States Patent
Chi

(10) Patent No.: US 9,900,706 B2
(45) Date of Patent: Feb. 20, 2018

(54) MICROSTRIP FILTER AND MICROPHONE DEVICE USING SAME

(71) Applicant: Sijie Chi, Shenzhen (CN)

(72) Inventor: Sijie Chi, Shenzhen (CN)

(73) Assignee: AAC TECHNOLOGIES PTE. LTD., Singapore (SG)

( * ) Notice: Subject to any disclaimer, the term of this patent is extended or adjusted under 35 U.S.C. 154(b) by 0 days.

(21) Appl. No.: 15/080,252

(22) Filed: Mar. 24, 2016

(65) Prior Publication Data

US 2017/0034633 A1 Feb. 2, 2017

(30) Foreign Application Priority Data

Jul. 28, 2015 (CN) ..... 2015 2 0553593 U

(51) Int. Cl.

| | |
|---|---|
| ***H04R 9/08*** | (2006.01) |
| ***H04R 19/04*** | (2006.01) |
| ***H01F 17/00*** | (2006.01) |
| ***H01P 1/203*** | (2006.01) |
| ***H04R 3/00*** | (2006.01) |

(52) U.S. Cl.

CPC ..... *H04R 19/04* (2013.01); *H01F 17/00* (2013.01); *H01P 1/20345* (2013.01); *H04R 3/00* (2013.01); *H04R 3/007* (2013.01)

(58) Field of Classification Search

CPC ..... H04R 2410/01; H04R 2499/11; H04R 31/00; H04R 17/025; H04R 1/028; H04R 1/086; H04R 1/326; H04R 2201/029; H04R 2203/12

USPC ..... 381/369; 333/116, 204, 246

See application file for complete search history.

(56) References Cited

U.S. PATENT DOCUMENTS

| | | | | |
|---|---|---|---|---|
| 5,955,931 | A * | 9/1999 | Kaneko | H03H 7/0115 333/175 |
| 6,714,113 | B1 * | 3/2004 | Abadeer | H01L 23/5227 257/531 |
| 2007/0120760 | A1 * | 5/2007 | Hsu | H01Q 1/242 343/895 |
| 2007/0296534 | A1 * | 12/2007 | Carastro | H01F 17/0013 336/200 |
| 2010/0039205 | A1 * | 2/2010 | Lee | H01F 17/0013 336/200 |
| 2012/0286899 | A1 * | 11/2012 | Lan | H01P 9/02 333/161 |
| 2014/0022027 | A1 * | 1/2014 | Cammarata | H01P 11/00 333/26 |
| 2014/0159828 | A1 * | 6/2014 | Shawley | H01P 3/088 333/12 |
| 2014/0294209 | A1 * | 10/2014 | Szczech | H04R 1/086 381/173 |
| 2015/0311577 | A1 * | 10/2015 | Yamatogi | H01P 5/187 333/116 |

* cited by examiner

*Primary Examiner* — Matthew Eason
*Assistant Examiner* — Julie X Dang
(74) *Attorney, Agent, or Firm* — Na Xu; IPro, PLLC

(57) ABSTRACT

A microstrip filter is provided in the present disclosure. The microstrip filter includes a substrate having a first surface and a second surface opposite to each other, a first spiral metal line formed on the first surface of the substrate, and a second spiral metal line formed on the second surface of the substrate. At least part of the first spiral metal line overlaps and is coupled to the second spiral metal line for forming a filter capacitor. The present disclosure also provides a microphone device using the microstrip filter.

8 Claims, 2 Drawing Sheets

MICROSTRIP FILTER AND MICROPHONE DEVICE USING SAME

FIELD OF THE DISCLOSURE

The present disclosure relates to filter technologies, and more particularly, to a microstrip filter and a microphone device using the microstrip filter.

BACKGROUND

With development of wireless communication technologies, wireless communication apparatuses such as mobile phones, tablet computers, or the like, become more and more widely. Filters are used in the wireless communication devices for removing some unwanted frequency components from electrical signals to obtain frequency bands as desired. For example, a microstrip filter may be applied in a microphone device of the wireless communication apparatus for filtering noise components.

A typical microstrip filter is designed in a printed circuit board (PCB) in form of a buried capacitor or buried resistor. However, the above-mentioned microstrip filter has a high manufacturing cost and normally needs to occupy unduly large space in the wireless communication device, and moreover, a buried-resistor type microstrip filter is liable to suffer breakdown during an electro-static discharge (ESD) test of the PCB. In other words, the above-mentioned microstrip filter may be inapplicable to the microphone device of the wireless communication apparatus.

Therefore, it is desired to provide a microstrip filter and a microphone device using the microstrip filter which can overcome the aforesaid problems.

BRIEF DESCRIPTION OF THE DRAWINGS

Many aspects of the embodiment can be better understood with reference to the following drawings. The components in the drawing are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

The present disclosure will be described in detail below with reference to the attached drawings and the embodiment thereof.

Figure 1:
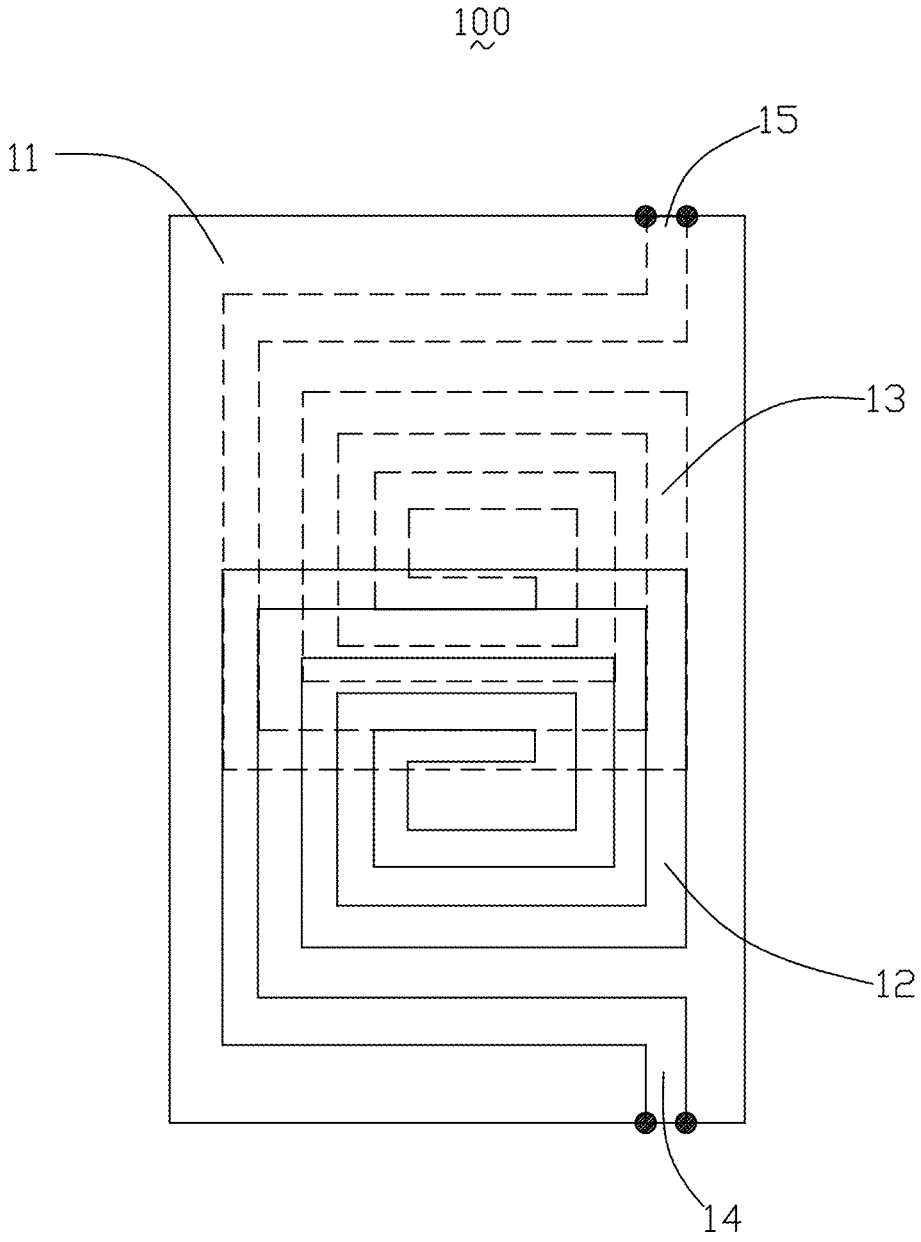
FIG. 1 is a planar, schematic view of a microstrip filter according to an embodiment of the present disclosure.

Referring to FIG. 1, a microstrip filter 100 according to an embodiment of the present disclosure is shown. The microstrip filter 100 may be applicable to a microphone device or other electronic device in a wireless communication apparatus. The microstrip filter 100 includes a substrate 11, a first spiral metal line 12, a second spiral metal line 13, a first signal transmitting terminal 14 and a second signal transmitting signal 15.

The substrate 11 may be a printed circuit board (PCB) substrate with two opposite surface, namely, a first surface and a second surface. The first spiral metal line 12 is formed on the first surface of the substrate 11, and the second spiral metal line 13 is formed on the second surface of the substrate 11. At least part of the first spiral metal line 12 overlaps the second spiral metal line 13, as illustrated in FIG. 1.

The first signal transmitting terminal 14 is arranged at an end of the first spiral metal line 12, and is electrically connected to the first spiral metal line 12. The second signal transmitting terminal 15 is arranged at an end of the second spiral metal line 13, and is electrically connected to the second spiral metal line 13. Moreover, the first signal transmitting terminal 14 and the second signal transmitting terminal 15 are respectively located at two opposite edges of the substrate 11.

In the present embodiment, both of the first spiral metal line 12 and the second spiral metal line 13 may be spiral copper lines, which are respectively formed by performing patterning process on copper foil layers of the substrate 11. For example, a first copper foil layer and a second copper layer may be provided on the first surface and the second surface of the substrate 11, and the first spiral metal line 12 and the second spiral metal line 13 may be formed by etching the first copper foil layer and the second copper foil layer respectively.

Because the second spiral metal line 13 is at least partly overlapped by the first spiral metal line 12, the first spiral metal line 12 and the second spiral metal line 13 are coupled to each other and cooperatively form a filter capacitor. A capacitance of the filter capacitor can be designed to enable the microstrip filter 100 to have a desired frequency passband by adjusting an overlaying area of the first spiral metal line 12 and the second spiral metal line 13 or adjusting a thickness of the substrate 11. For example, each of the first spiral metal line 12 and the second spiral metal line 13 may be designed to have an appropriate line width, an appropriate line pitch, or an appropriate shape.

For example, in the present embodiment as illustrated in FIG. 1, the first spiral metal line 12 and the second spiral metal line 13 are both configured as a rectangular spiral with a same line width and a same line pitch, and the first spiral metal line 12 and the second spiral metal line 13 are symmetrical to each other about an central axis of the substrate 11. In other embodiment, the first spiral metal line 12 and the second spiral metal line 13 may alternatively have different line widths or different line pitches.

In the microstrip filter 100 according to the present disclosure, the filter capacitor is provided therein by forming the first spiral metal line 12 and the second spiral metal line 13 on the substrate 11. Therefore, the microstrip filter 100 has a simple structure which can reduce a manufacturing cost thereof. Furthermore, because the spiral configuration of the first spiral metal line 12 and the second spiral metal line 13 can enable the microstrip filter 100 to occupy a smaller space, and thus meeting miniaturization requirement of a microphone device in which the microstrip filter 100 is applied.

Figure 2:
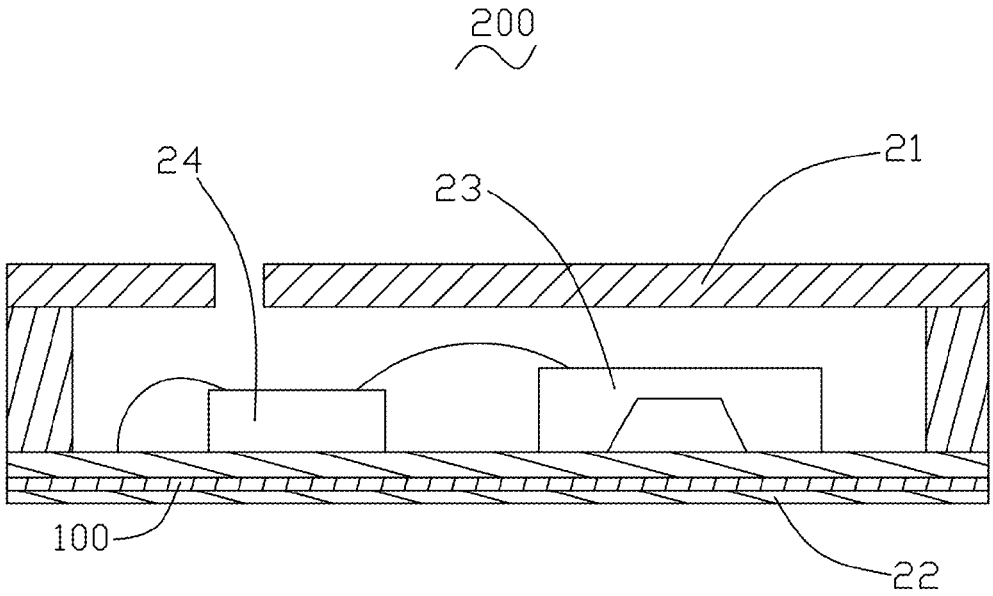
FIG. 2 is a schematic view of a microphone device using the microstrip filter of FIG. 1.

Based on the above-described microstrip filter 100, the present disclosure further provides a microphone device 200 as illustrated FIG. 2. The microphone device 200 includes a shell 21, a circuit board 22, a transducer 23, an integrated circuit (IC) chip 24 and the microstrip filter 100.

The shell 21 covers the circuit board 22 to form an accommodating space for accommodating the transducer 23 and the IC chip 24. The transducer 23 and the IC chip 24 are both installed on the circuit board 22, and are electrically connected with each other. The circuit board 22 may be a multi-layer circuit board, and the microstrip filter 100 is integrated into the circuit board 22 as a circuit layer of the circuit board 22. As such, the microstrip filter 100 does not need to take up an extra space in the microphone device 200, which is good for the miniaturization of the microphone device 200.

The first signal transmitting terminal 14 of the microstrip filter 100 is electrically connected to the IC chip 24, and the second signal transmitting terminal 15 of the microstrip filter 100 is grounded via the circuit board 22. The IC chip 24 may be configured for performing signal processing on an electrical signal outputted by the transducer 23, and an output signal of the IC chip 24 is further filtered by the microstrip filter 100. The microstrip filter 100 provides a low impedance path for removing high frequency noise of the output signal to ground and allowing other frequency components to transmit through.

It is to be understood, however, that even though numerous characteristics and advantages of the present embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A microphone device, comprising:

a circuit board;

a transducer and an integrated circuit (IC) chip both installed on the circuit board; and a microstrip filter integrated into the circuit board;

wherein the microstrip filter comprises a substrate having a first surface and a second surface opposite to each other, a first spiral metal line formed on the first surface of the substrate, and a second spiral metal line formed on the second surface of the substrate; at least part of the first spiral metal line overlaps and is coupled to the second spiral metal line for forming a filter capacitor, the first spiral metal line is electrically connected to the IC chip, the second spiral metal line is grounded, the microstrip filter provides a low impedance path for removing high frequency noise of an output signal of the IC chip to ground.

2. The microphone device of claim 1, wherein the circuit board is a multi-layer circuit board; the microstrip filter is formed as a circuit layer of the circuit board.

3. The microphone device of claim 2, wherein the microstrip filter further comprises a first signal transmitting terminal and a second signal transmitting terminal, the first signal transmitting terminal is arranged at and electrically connected to an end of the first spiral metal line, and the second signal transmitting terminal is arranged at and electrically connected to an end of the second spiral metal line.

4. The microphone device of claim 3, wherein the first signal transmitting terminal and the second signal transmitting terminal are respectively located at two opposite edges of the substrate.

5. The microphone device of claim 4, wherein the first signal transmitting terminal of the microstrip filter is electrically connected to the IC chip, and the second signal transmitting terminal of the microstrip filter is grounded via the circuit board.

6. The microphone device of claim 1, wherein the first spiral metal line and the second spiral metal line are spiral copper lines respectively formed by patterning on copper foil layers of the substrate.

7. The microphone device of claim 6, wherein the first spiral metal line and the second spiral metal line both have a rectangular spiral configuration.

8. The microphone device of claim 7, wherein the first spiral metal line and the second spiral metal line have a same line width and a same line pitch.

* * * * *